United States Patent [19]

Hagelberg et al.

[11] 4,372,239

[45] Feb. 8, 1983

[54] UNDERSEA WEAPON WITH HYDROPULSE SYSTEM AND PERIODICAL SEAWATER ADMISSION

[75] Inventors: Allen C. Hagelberg, Diamond Bar; Clark E. Allardt, Claremont; Walter A. Lobitz, Westwood; Robert O. Thornburg, Blue Jay; George F. Zimmerman, Diamond Bar; Gary L. Letterman, Alta Loma; John W. Helbron, Upland, all of Calif.

[73] Assignee: General Dynamics, Pomona Division, Pomona, Calif.

[21] Appl. No.: 126,782

[22] Filed: Mar. 3, 1980

[51] Int. Cl.[3] ..... F42B 19/00

[52] U.S. Cl. ..... 114/20 A; 114/25; 367/133

[58] Field of Search ..... 114/20 A, 25; 367/131-135

[56] References Cited

U.S. PATENT DOCUMENTS

| | | | |
|---|---|---|---|
| 1,117,351 | 11/1914 | Edlin | 60/221 |
| 1,315,352 | 9/1919 | Torazzi | 114/20 |
| 2,351,750 | 6/1944 | Fawkes | 60/221 X |
| 2,644,397 | 7/1953 | Katz | 114/20 A |
| 2,714,800 | 8/1955 | Gongwer | 60/221 |
| 2,903,850 | 9/1959 | Lang | 60/221 |
| 2,938,481 | 5/1960 | Maxwell et al. . | |
| 2,971,325 | 2/1961 | Gongwer | 60/221 X |
| 3,000,306 | 9/1961 | Wenzel et al. | 60/245 X |
| 3,060,682 | 10/1962 | Kemenczky | 60/221 X |
| 3,079,753 | 3/1963 | Gongwer | 60/227 |
| 3,088,403 | 5/1963 | Bartling et al. . | |
| 3,102,505 | 9/1963 | Dickieson | 114/25 X |
| 3,107,486 | 10/1963 | Linderfelt | 60/221 |
| 3,137,997 | 6/1964 | Kaminstein | 60/221 |
| 3,154,041 | 10/1964 | McKinnon | 114/25 X |
| 3,157,992 | 11/1964 | Kemenczky | 60/221 |
| 3,163,980 | 1/1965 | Turner | 60/221 |
| 3,335,685 | 8/1967 | Gimbel | 114/333 |
| 3,354,648 | 11/1967 | Asahina | 60/221 |
| 3,565,028 | 2/1971 | Hancks et al. | 114/20 A |
| 3,738,270 | 6/1973 | Hargett et al. | 102/7 |
| 3,853,081 | 12/1974 | Daudelin et al. | 114/20 A |
| 3,872,665 | 3/1975 | Jarry | 60/221 |
| 3,875,552 | 4/1975 | Hogman et al. | 114/25 X |
| 3,914,935 | 10/1975 | Burkes, Jr. | 60/250 X |
| 3,951,094 | 4/1976 | Jastrom | 60/221 X |
| 4,186,373 | 1/1980 | Thompson | 367/134 X |
| 4,200,920 | 4/1980 | Evans et al. | 114/25 X |
| 4,239,012 | 12/1980 | Kowalyshyn et al. | 114/21 A X |

FOREIGN PATENT DOCUMENTS

| | | | |
|---|---|---|---|
| 933570 | 8/1963 | United Kingdom | 114/20 A |

*Primary Examiner*—Peter A. Nelson

*Attorney, Agent, or Firm*—Henry M. Bissell; Edward B. Johnson

[57] ABSTRACT

An undersea weapon comprising a warhead, a rocket motor, detection, homing and control systems and a hydropulse underwater propulsion system in an integral unit. The weapon is launched at a previously detected target, such as a submarine, on a ballistic trajectory through the air by means of the rocket motor. The weapon enters the water near the submarine, which is thereafter detected by an on-board system incorporating active and/or passive detection. The thus-determined submarine direction is utilized by the control system to guide the weapon toward the submarine under water. A hydropulse motor utilizes the empty rocket motor as the propulsion chamber and provides the underwater propulsion to propel the weapon through the water toward the submarine, where the warhead then detonates on contact with the submarine. Alternatively, the weapon may be air dropped near a previously detected target, in which case there need be no propellant in the rocket motor. The hydropulse motor operates by repeatedly filling the chamber with water and expelling the water at high velocity through a converging nozzle in succeeding pulse stages. During the intervals between pulses, the detection system monitors the submarine free of noise from the on-board propulsion motor.

25 Claims, 9 Drawing Figures

UNDERSEA WEAPON WITH HYDROPULSE SYSTEM AND PERIODICAL SEAWATER ADMISSION

BACKGROUND OF THE INVENTION

1. Field of the Invention

This invention relates to anti-submarine weapons and, more particularly, to such weapons which may be directed over water to the vicinity of a submarine or similar target where the weapon, after entering the water, propels itself to home on the submarine.

2. Description of the Prior Art

The problems of anti-submarine warfare (ASW) have long been a serious concern of the United States and of many other nations. The capability of waging war effectively and of defending against attack by other nations depends in part upon protecting merchant shipping and naval vessels against attack by enemy submarines. Techniques for detecting enemy submarines have developed to a very sophisticated level. However, the ability to deliver a warhead to a point where destruction of the submarine is virtually assured has not kept pace.

Since World War II, the effective range of depth charges has been extended by the inclusion of rocket propulsion systems to direct the weapon farther out from the launching ship. While this extends the range and thus increases the safety of the launching ship, these weapons must still drop almost directly on the enemy submarine in order to be assured of a kill. More sophisticated ASW weapons have been developed in the form of anti-submarine torpedoes having the capability of detecting and homing on a submarine after the torpedo is in the water. The ASROC system has been developed to provide air launching and delivery of a torpedo to the vicinity of a submarine, where the torpedo enters the water and thereafter detects the submarine and homes on it for the kill. Such systems are incredibly complex and expensive, the cost of a single such weapon currently being on the order of $500,000 to $750,000. Moreover, such weapons are vulnerable to countermeasures generated by the submarine and furthermore are largely ineffective in shallow water (less than 100 fathoms) or against surfaced submarines. This means that enemy submarines can operate with considerable impunity on the surface or within very large areas along the continental shelves while preying upon coastal and intercontinental shipping within such regions. It is clearly extremely important to be able to provide an anti-submarine weapon which is more effective in operation, particularly with surfaced submarines and in shallow coastal waters, and is also more cost-effective in the sense of being simpler and less expensive to manufacture and operate.

Various examples of attempts to develop weapons for use in anti-submarine warfare are known in the prior art.

The Bartling et al U.S. Pat. No. 3,088,403 covers the currently operational ASROC weapon consisting of a MK 46 torpedo or depth charge, a rocket motor and a parachute pack. Upon entering the water, the torpedo separates from the other items to home on the submarine. However, detection of the submarine is limited to forward-looking detection systems which may not be able to detect a submarine laterally displaced from the water entry point unless the torpedo is initially directed in a hunt mode to circle and seek the submarine. The Bertheas U.S. Pat. No. 3,745,956 discloses a weapon which is rocket or gun launched to enter the water where it sinks to intercept the submarine. It has no underwater propulsion system but provides some control of sink direction in respone to acoustic detection of submarine noise. The Bradley U.S. Pat. No. 2,513,279 describes using reflected energy for homing or control in connection with all types of military systems, both over land or water, underwater, and between shore batteries and naval ships, to name a few. This patent appears to be a shotgun disclosure directed at every conceivable system using reflected energy for the purpose stated but fails to provide a truly operational disclosure of any system.

The Mueller U.S. Pat. No. 3,010,416, Sheffet U.S. Pat. No. 3,137,817 and Kalmus U.S. Pat. No. 3,121,228 relate to various types of radio frequency detecting and control systems.

The Gongwer U.S. Pat. Nos. 2,945,343 and 2,971,325, Torazzi U.S. Pat. No. 1,315,352, Zwicky U.S. Pat. No. 3,044,252, Chandler U.S. Pat. No. 3,087,451, and Hodgson U.S. Pat. No. 3,158,994 relate to various types of underwater vehicles and propulsion systems, some of which include warheads and control mechanisms to comprise homing torpedoes.

Despite the plethora of prior art attempts to solve the problems relative to anti-submarine warfare, specifically in underwater detection and propulsion, no solution such as is provided by the present invention has been heretofore developed.

SUMMARY OF THE INVENTION

In brief, arrangements in accordance with the present invention incorporate a weapon for use against submarines, mines and similar targets, the weapon having a warhead, both passive and active systems for detecting the target underwater and for controlling the weapon to home on the target, a simple but effective underwater propulsion system for driving the weapon underwater at speeds effective to intercept a moving target within a reasonable range of the weapon, and provision for delivery of the weapon to the vicinity of a previously detected underwater target. The present invention is particularly effective as an anti-submarine weapon and will be described herein in such a context. However, it should be clearly understood that it is not so limited but is also particularly effective against underwater mines, both the floating and the moored and rising types of mines, within the effective depth range (100 fathoms) of the weapon. Devices in accordance with the invention are more effective than a depth charge, in that they include both guidance and propulsion systems, but are much less complex than the torpedo, which has been developed along different design principles and objectives.

In one particular arrangement in accordance with the invention, the weapon includes a rocket motor for propelling itself through the air from a mother ship to the vicinity of the target. After entry into the water, the rocket chamber is utilized as the chamber for a hydropulse propulsion system to drive the weapon underwater in intercepting the target. The hydropulse motor operates by repeatedly filling the rocket chamber with water and then expelling the water at high velocity through a nozzle at the stern of the weapon by means of a series of gas generators which are successively ignited. During the burning of one of the gas generators with the consequent expulsion of the water from the chamber to accelerate the vehicle to intercept the target, substantial self-noise is generated. However, during intervals between pulses, while the vehicle is coasting, the self-noise is minimal and active or passive acoustic detectors on the vehicle are able to listen to noise from the submarine; control of the homing is fairly simple, particularly where the submarine is moving.

In a second particular arrangement in accordance with the invention, the weapon is arranged for delivery by a helicoptor or other ASW aircraft to the vicinity of the target. In this arrangement, the rocket chamber is empty of propellant but still serves as the propulsion chamber of the hydropulse system once the weapon vehicle is dropped into the water.

Embodiments of the present invention have been particularly designed for use in conjunction with existing launch systems, such as those used for launching rocket-propelled depth charges. Examples of such are the Terne III Rail Launcher, the LIMBO mortar MK 10 system, the Bofors 375 rocket launching system, and the Squid system. Embodiments of the present invention are readily adaptable for launching by means of the launch equipment already installed on existing ASW ships of the respective NATO and Pacific Ocean Allied countries. In use with any particular one of these systems which fires what is essentially a depth charge without underwater propulsion, arrangements in accordance with the present invention add the range in excess of 1500 feet to the range of the system without underwater propulsion. In addition, however, and far more important, the present invention is effective to intercept a moving submarine and make actual contact with the submarine so as to explode the warhead directly against the hull, thus compensating for downrange and cross-range errors in the launching of the depth charges of the above-mentioned systems, which often result in little or no damage to the submarine because the miss distance is too great. Thus a substantially improved kill ratio is achieved. The new design is operative with existing systems already installed on ships for the prior art depth charge launch systems and the like, such as the sonar, fire control and launching systems on the ASW ship which serve to detect the submarine and control the launching of the weapon. Where the weapon is carried by ASW helicopters and aircraft, conventional detection systems prior to weapon drop are also utilized.

Another, particularly significant use of the weapon of the invention may be for defense against a following submarine. A series of the weapons may be deposited in the path of a following submarine by a surface vessel or fleet submarine. By suitable timing or detection systems, the weapons may be activated after the deposting vessel is out of range to locate and intercept the following submarine. A particular benefit accrues from the capabilities designed into the present weapon, since it does not have the combination of speed and range to overtake a moderately high speed surface vessel or submarine. Thus, the depositing vessel is safe from contact with its own weapons. (Torpedoes have been known to change course and to home on and destroy the very submarine from which they were fired.)

Because of the simplicity of the design of weapons in accordance with the present invention, the integral construction, the ruggedness of the propulsion, detection and control systems which are employed, and the common utilization of the same structure for both overwater and underwater propulsion, these new weapons are relatively simple and cheap to manufacture. The cost of a single weapon of the present invention, for example, is from 2% to 5% of the cost of a corresponding ASROC weapon.

BRIEF DESCRIPTION OF THE DRAWING

A better understanding of the present invention may be had from a consideration of the following detailed description, taken in conjunction with the accompanying drawing, in which.

DESCRIPTION OF THE PREFERRED EMBODIMENTS

Figure 1:
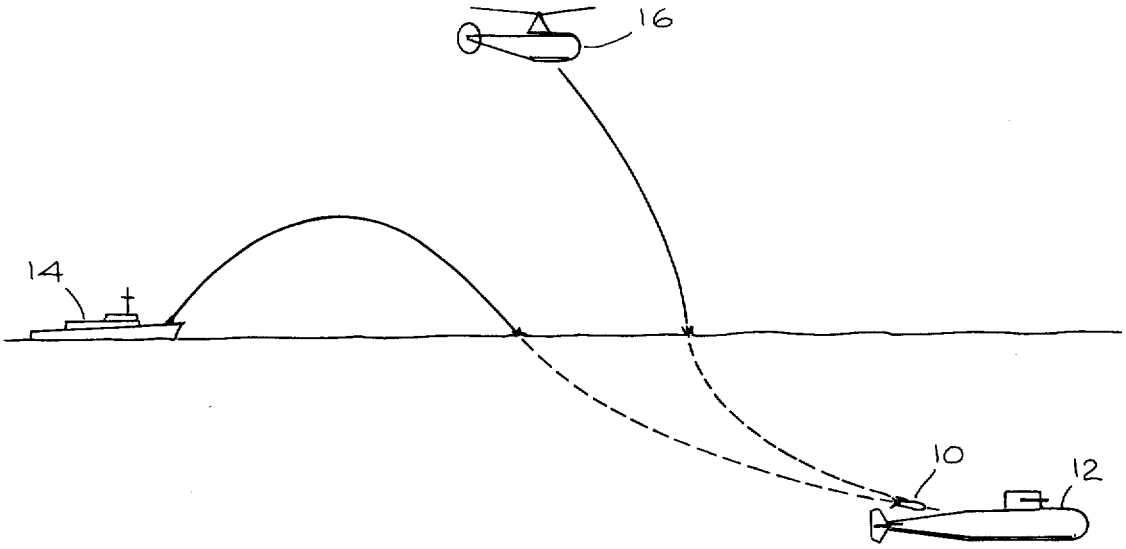
FIG. 1 is a schematic representation of modes of operation of systems in accordance with the present invention.

FIG. 1 illustrates schematically the delivery of an underwater weapon 10 in accordance with the invention to destroy a submarine 12. Delivery from a ship 14 or helicopter 16 is illustrated in FIG. 1. If the former, delivery of the weapon 10 from the ship 14 to the vicinity of the submarine 12 is effected over a ballistic trajectory by means of one of the systems already referenced above for firing rocket-propelled depth charges. The ship 14 initiates such a rocket firing upon detecting the submarine 12 in the vicinity of the ship 14, by way of sonar or passive acoustic detection techniques. Once in the water, the underwater detection, guidance and propulsion system takes over and the weapon 10 is directed and propelled toward contact with the submarine 12 for a kill. The warhead of the weapon 10 with 150 pounds of explosive can cause hull rupture of even a modern, double-hulled submarine when exploded upon contact.

Where the weapon 10 is dropped from an aircraft, such as the helicopter 16 or other ASW aircraft, the weapon 10 is dropped near the submarine where it will independently detect the submarine 12 and home on it to detonate the warhead on contact. The ASW aircraft or helicopter 16 carrying the weapon 10 can be vectored to the vicinity of the submarine 12 by a surface ship, or it can locate the target by means of sonobuoys, dipping sonar, or magnetic anomaly detection. If desired, a parachute pack (not shown), similar to that which is disclosed in the above-referenced Bartling et al patent (ASROC), may be used to slow the descent prior to water entry. As disclosed in that patent, the parachute pack would be jettisoned prior to total submersion. In the air-dropped mode, the weapon 10 can be carried on, and dropped from, any ASW aircraft or helicopter which is equipped to carry conventional torpedoes. By virtue of its size and configuration, it is capable of using the same torpedo suspension bands which are attached to conventional bomb racks for torpedo-carrying aircraft, without special modification. Air drop of the weapon 10 can be initialized by the pulling of an arming wire which serves to activate the primary battery, thus energizing the electronic systems. Arming of the warhead is precluded by the safe and arm mechanism associated with the detonator 44 (FIG. 3) until the weapon impacts the water. With presently available techniques, the submarine 12 can be localized and the weapon 10 placed in the water from the helicopter 16 within 100 to 400 yards of the target. Alternatively, when fired from the ship 14, the weapon 10 can again be placed in the water within an equivalent range. This is well within the range capability of the weapon 10 to acoustically detect the target and home on it, and of the hydropulse propulsion system to intercept the submarine.

Figure 2:
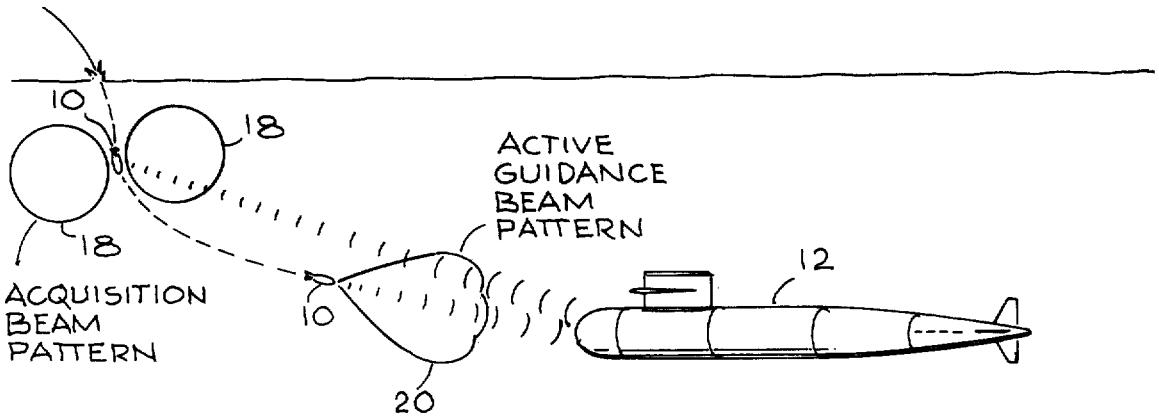
FIG. 2 is a schematic representation showing acquisition of target and guidance of a weapon in accordance with the invention toward a target following entrance into the water.
Figure 5:
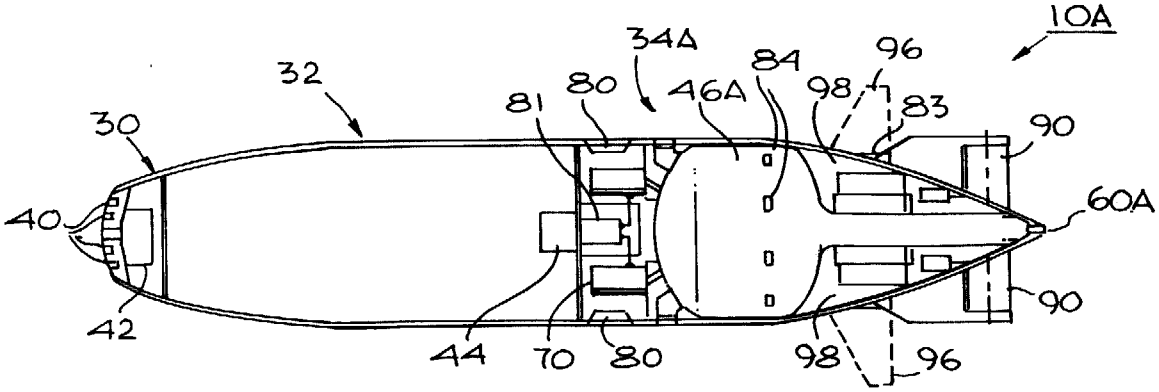
FIG. 5 is a sectional view of a slightly different arrangement in accordance with the present invention.

After entering the water (see FIG. 2) the weapon 10 decelerates rapidly to its nominal sink rate, with a nearly vertical attitude. Hydrobrakes (as shown in FIG. 5) may be employed to slow the vehicle and permit operation in water depths as shallow as 100 feet. The weapon 10 is then steered in the direction of the target by the actuation of its control surfaces in response to target detection. Once the water entry cavity (bubble) collapses, side mounted sonar transducers transmit and receive to acquire the target. The side-mounted transducers sweep out a volume of water in a torus surrounding the weapon 10 and extending to the limit of the range of the detection system. Because the weapon is initially oriented in a nearly vertical attitude, the target detection capability is omnidirectional and provides a doppler discrimination down to 2.5 knots target speed, as contrasted with the detection capability of a torpedo which must point toward its target and be chasing during detection. The acquisition beam pattern 18 from the side mounted transducers is shown in FIG. 2, as is the active guidance beam pattern (20) which is transmitted from a separate, nose-located sonar transducer which comes into play to actively determine steering corrections to the target. The weapon 10 achieves an average underwater velocity of 30 knots to a range of approximately 1500 feet. Maximum target speed is assumed to be in the range of 5 to 7 knots in shallow water depths of from 100 to 200 feet. If submarines with speeds above this are to be attacked, the weapon may be dropped leading the target.

After weapon 10 enters the water, its motor chamber is allowed to fill with sea water. A hot gas generator is then fired to expel the water through a nozzle and provide thrust. By alternate filling and expulsion of water, the weapon 10 is propelled through the water.

Figure 3:
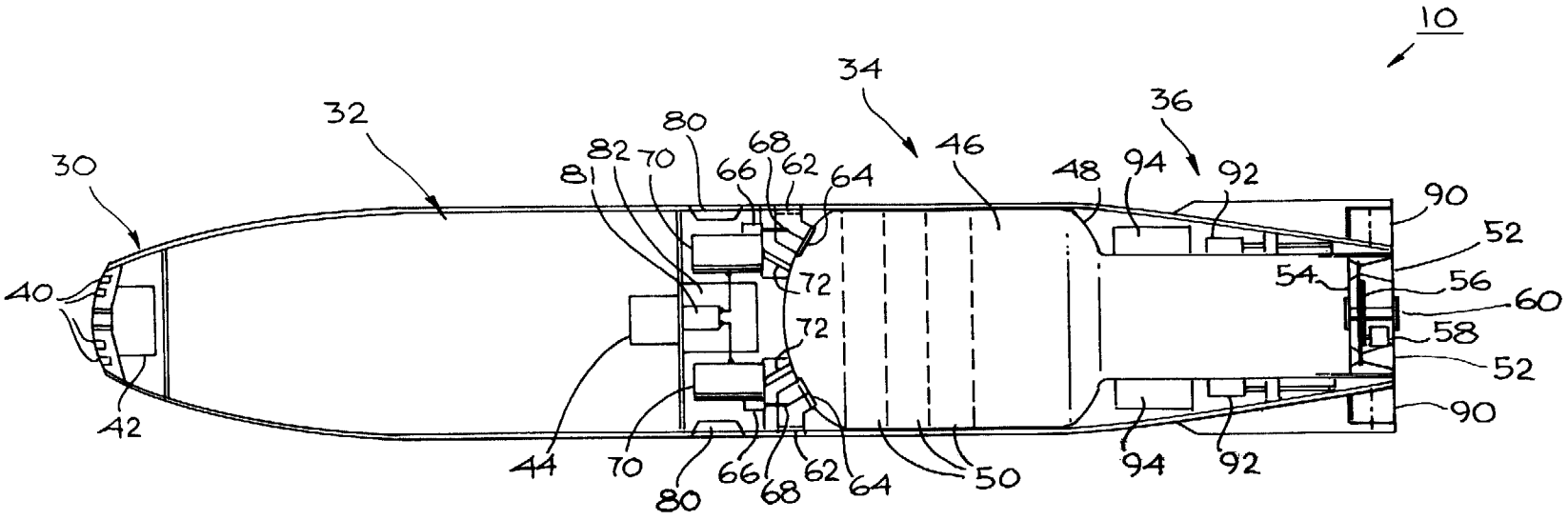
FIG. 3 is sectional diagram of one particular arrangement in accordance with the invention.
Figure 4:
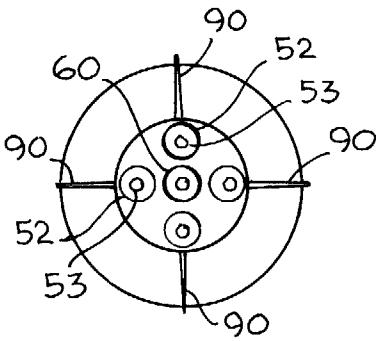
FIG. 4 is an end view of the device of FIG. 3.

FIGS. 3 and 4, respectively sectional plan and end views, illustrate schematically one particular arrangement in accordance with the invention. As particularly shown in FIG. 3, the weapon 10 is generally divided into four major sections: a forward transducer section and transceiver 30, a warhead 32, a propulsion system 34 and a directional control system 36.

The forward section 30 contains a mosaic array of acoustic transducers 40 mounted in the nose and a related transmitter and receiver making up an active, high power, monopulse tracking system. The transmitter, receiver and a contact fuze for the warhead are mounted in the block 42 behind the transducers.

The warhead 32 preferably contains 150 pounds of explosive substantially filling the warhead chamber, together with a safe and arm protected detonator 44 shown to the rear of the warhead. A tube (not shown) is provided to carry the cabling from the processor 82 to the nose for connection to the transmitter and receiver.

The propulsion system 34 is dual purpose. Its major component is the chamber 46 enclosed by a housing 48. For rocket propulsion, the chamber 46 contains one or more segmented-grain burn units 50 and a plurality of gas exhaust nozzles 52. The rocket propulsion system serves to drive the weapon 10 from shipboard launch to water entry in the vicinity of a target, as shown in FIG. 1. The burn units 50 will have been completely consumed by the time the weapon 10 enters the water. At this point, the gas jet nozzles 52 are closed by means of a rotatable plate 54 having a plurality of holes matching the openings in the gas jet nozzles 52. The plate 54 is rotated until its holes are no longer in alignment with the gas nozzle openings by means of a gear arrangement 56 and electric motor 58. Thus the gas nozzles 52 are closed off, leaving as the only opening to the aft end of the chamber 46, a water jet nozzle 60.

For propulsion under water, the chamber 46 is permitted to fill with water and thereafter a gas generator is ignited to drive the water outward through the nozzle 60, thereby generating a hydropulse of thrust. Sea water enters the chamber 46 through inlet passages 62 and valves 64. The valves are controlled by solenoids 66 and associated linkages 68. A plurality of gas generators 70, communicating with the chamber 46 via tubes 72, are spaced circumferentially about the longitudinal axis of the weapon 10 and fired in succession to generate a series of hydropulses to propel the weapon through the water.

Also located in the region between the chamber 46 and the warhead 32 are a plurality of side mounted acoustic transducers 80, which are used to initially locate the submarine target, and a primary battery and signal processor 81 mounted in the central block 82.

The aft section 36 contains the steering system for the vehicle comprising the steering planes 90, actuators 92 and control electronics and related systems which are mounted within the blocks 94.

An alternative embodiment of the present invention is depicted in FIG. 5. The weapon 10A of FIG. 5 is specifically designed to be air dropped from a helicopter or other ASW aircraft and therefore has dispensed with the rocket propulsion motor of the weapon of FIG. 3. This weapon 10A is essentially like the weapon 10 of FIGS. 3 and 4, the principal difference being the absence of a rocket propulsion system in the chamber 46A. This chamber is provided with a single exit nozzle 60A for exiting the sea water jet which is driven out of the chamber 46A by means of the gas generators 70 in the same manner as the hydropulse portion of the propulsion system 34 of the vehicle 10 of FIG. 3. As indicated above, the gas generators 70 fire sequentially at intervals controlled by the microprocessor 81 in the central block 82 whenever the weapon speed drops to a predetermined level and the chamber 46A has filled with water, as detected by speed sensors 83 and floats 84.

Another difference from the weapon 10 of FIG. 3 is the provision of hydrobrakes 96 in the weapon 10A. These may be stored on or within compartments 98 and extended outwardly in order to slow the weapon 10A and permit it to operate at a shallower depth. Once the entry velocity is dissipated, the hydrobrakes 96 may be retracted into storage compartments 98. Alternatively, the brakes 96 may be extended upon detaching the weapon 10A from the delivery aircraft, in which case they serve as both aero and hydrobrakes. The brakes 96 may, if desired, be jettisoned from the vehicle 10A as soon as they have slowed the vehicle upon entry into the water, so that they do not later serve as a drag during propulsion of the weapon toward target.

Figure 6:
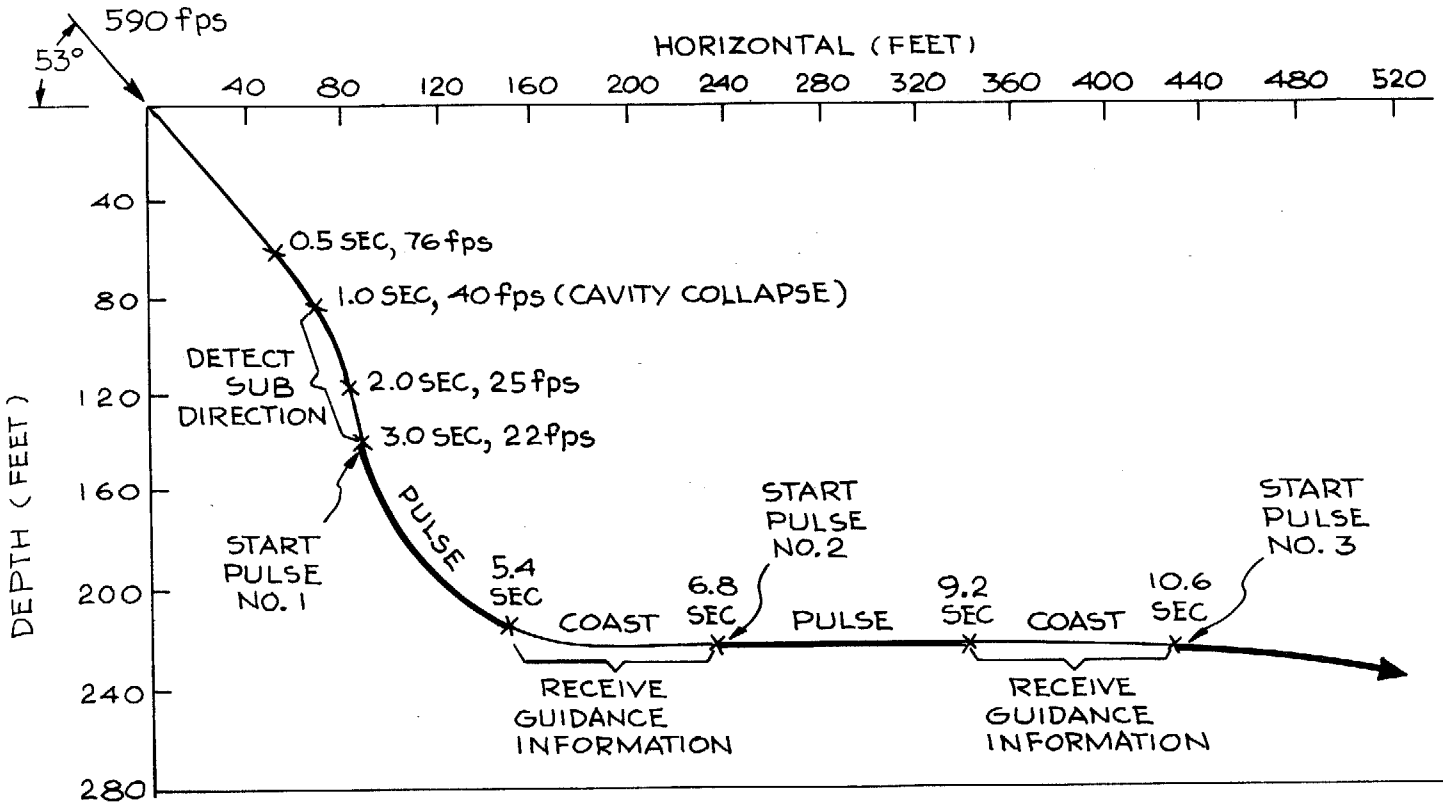
FIG. 6 is a graph illustrating initial operation of the invention.

FIG. 6 is a graphical plot illustrating typical initial operation of the hydropulse propulsion system of the weapon upon initial entry into the water. FIG. 6 illustrates the course of the weapon beginning at water entry with a typical entry angle of 53 degrees and velocity of 590 ft. per second (fps). Within one-half second following water entry, the velocity has dropped to 76 fps., and at one second after entry the velocity has dropped to 40 fps., at which time the bubble cavity about the weapon collapses so that water contact is established with the acoustic transducers. During the next two seconds, the direction of the submarine target is detected by means of the side mounted transducers 80 and the hydropulse chamber is filled with water. Thereafter, the first gas generator 70 is fired to generate the first hydropulse. This accelerates the weapon and enables it to turn in the direction of the target. The weapon may, if desired, be turned in the direction of the target prior to the first hydropulse. Following the first hydropulse, the vehicle coasts and receives guidance information while its propulsion chamber is again filled with sea water. Thereafter, a second gas generator is ignited to develop a second hydropulse which again accelerates the vehicle and propels it toward the submarine. The sequence is repeated until the submarine is destroyed or the gas generators are exhausted, the vehicle alternately coasting while it receives guidance information and propelling itself toward the target.

Figure 7:
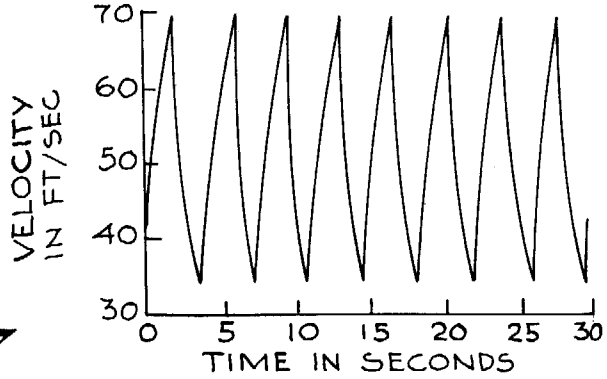
FIG. 7 is a graph illustrating a velocity profile of apparatus of the invention during underwater propulsion.

FIG. 7 is a graphical plot of the velocity profile of the weapon. From this plot, it may be seen that velocity varies between approximately 35 and 70 fps. during successive hydropulses, with an average velocity of approximately 50 fps. or 30 knots. This is adequate to deal with most submarine targets, particularly in the shallow water conditions for which the weapon is designed. Where the submarine is running, the delivery system can drop the weapon into the water ahead of the submarine, thus developing the necessary lead for intercept and kill.

By virtue of its mode of operation, the weapon system of the present invention is uniquely adapted to deal with the problems of underwater target detection encountered during propulsion to the target. The function of the guidance system is to locate the target and to generate steering commands. The guidance system must overcome problems of self-noise, surface and bottom reverberation, and target acquisition. Underwater weapons like acoustic homing torpedoes using acoustic guidance are usually performance-limited by self-noise. If they move slowly, the acoustic sonar can measure the target location, the velocity and other necessary parameters with a high signal-to-noise ratio and, therefore, with improved accuracy. However, the higher speed moving target will have a better chance to escape. The higher the weapon velocity, the higher the self-noise until at about 35 knots the guidance becomes noise limited and the system performance is degraded. This limiting noise is due to weapon propulsion and flow noise.

However, the weapon of the present invention provides a unique solution to this problem. The hydropulse motor provides a varying velocity profile for the weapon with a velocity below 35 knots for a substantial proportion of the time. During this time, the acoustic system is activated and operates in a self-noise-free environment with the necessary error measurements. This technique of observing the target only when the self-noise is low solves the self-noise problem.

To allow suitable filling times and rational chamber pressures, the motor timing cycle on our base line design is on the order of 3.5 seconds per pulse. Using the low velocity "quiet time" for acoustic target measurement restricts the error update time for every motor pulse to approximately 0.3 to 1 "look" per second. While this relatively low data rate for the guidance system may develop a lag in the target homing, particularly when the target is approached from the side, this lag improves the kill probability by biasing the weapon contact to the more vulnerable area behind the center of the submarine. Another factor associated with the varying weapon velocity is the non-linear relationship between steering forces and angular turning rate. This dynamic variable is processed by a microcomputer included in the guidance sub-system.

Detecting and tracking a submarine in shallow water requires a quality of signal-to-reverberation level sufficient to meet detection, false alarm, and guidance accuracy requirements. Major factors influencing the reverberation levels are: transducer beam pattern, sea surface conditions, surface grazing angle, bottom surface conditions, bottom grazing angle, and frequency of operation.

A pulse of acoustic energy insonifies the body of water and boundary surfaces. As a wave progresses forward, it causes reflections from the boundaries and the target. Grazing angles, surface angles, and distance to insonified areas change as a function of time. Larger beam patterns cause more area to be insonified, creating more reverberation. Eventually the distance effect predominates, causing the reverberation to cease. The reverberation at any instant of time is given by the integral over the surface areas. Evaluation for this integral for typical geometries shows reverberation backscattering coefficients to be in the region of $-15$ to $-10$ dB at 100 kHz for 40 degree beam widths. With targets above $-5$ dB sufficent target-to-reverberation ratio is available for quality detection and tracking on a single pulse basis. In general, weapons in accordance with the present invention develop a target acquisition range of approximately 1500 feet.

Figure 8:
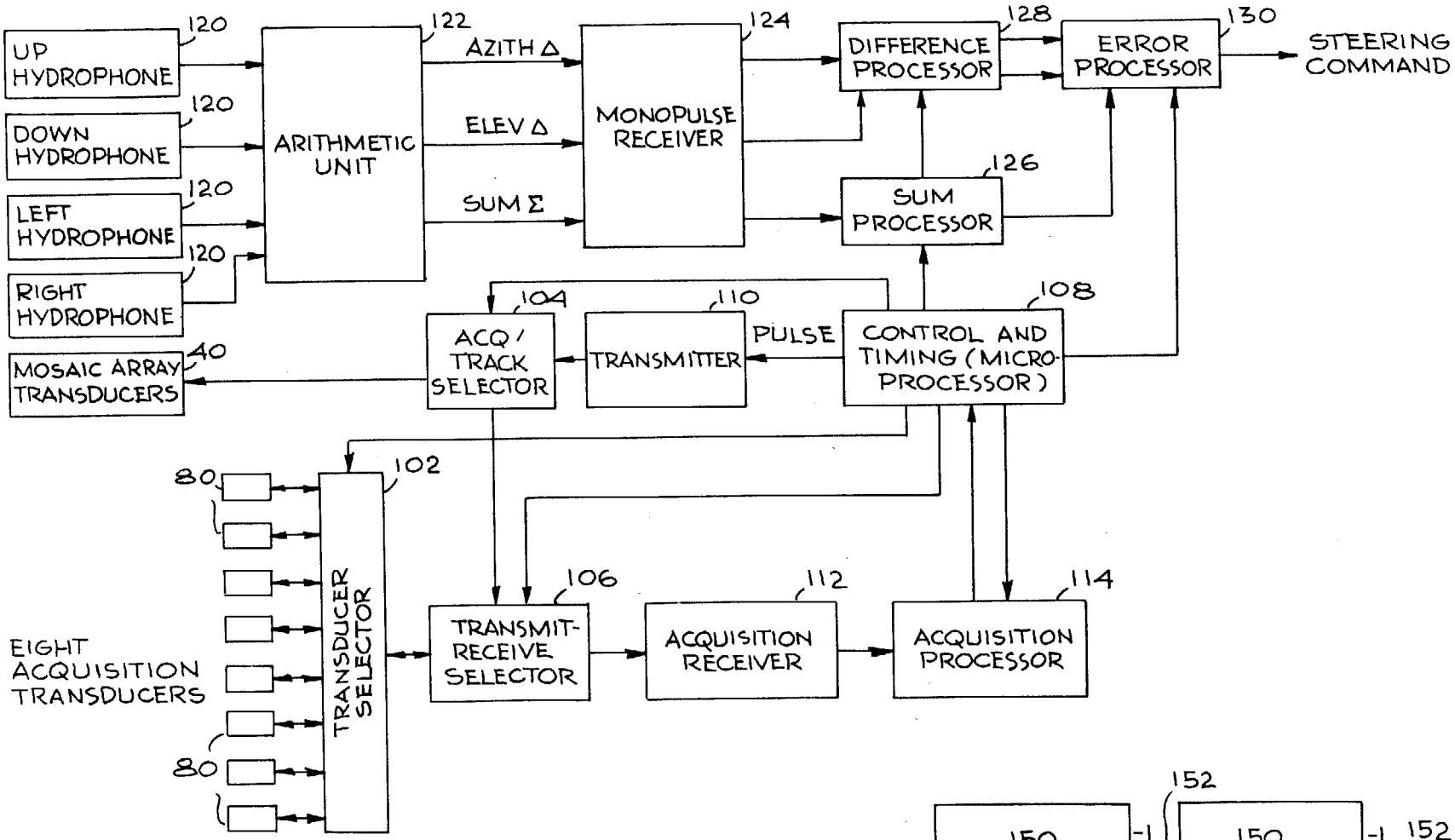
FIG. 8 is a block diagram illustrating the detection and guidance system employed in apparatus of the invention.
Figure 9:
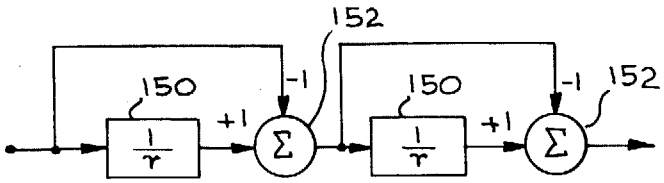
FIG. 9 is a block diagram of a particular portion of the circuitry of FIG. 8.

FIGS. 8 and 9 illustrate in block diagram form the guidance sub-system included in weapons embodying the present invention. As seen particularly in FIG. 8, two sonar systems are provided, one for acquisition (or search) and one for track. These respective systems have signal processors tailored to specific applications.

The acquisition system comprises eight side mounted transducers 80 coupled to a transducer selector 102. The mosaic array 40 of the tracking system is coupled to the acquisition/track selector 104 which makes the selection between the acquisition and tracking systems by virtue of its additional connection to a transmit/-receive selector 106 which is coupled to the transducer selector 102 of the acquisition system. The selectors 102, 104, 106 are coupled to receive control signals from a control and timing microprocessor 108 which also provides a pulse signal to trigger a transmitter 110 coupled to provide its output pulse to the selector 104. Signals from the selector 106 are directed to an acquisition receiver 112 and thence to an acquisition processor 114 which is coupled to the microprocessor 108.

The receiver for the tracking sonar system comprises four hydrophones 120 mounted within the mosaic array 40. The hydrophones 120 are coupled to an arithmetic unit 122 which provides a summing signal plus differential azimuth and elevation signals to a monopulse receiver 124. This receiver 124 provides output signals to sum and difference processors 126 and 128 which in turn provide signals to an error processor 130 which generates the steering commands applied to control elements 92 (see FIG. 3). The microprocessor 108 is also coupled to the processors 126, 128 and 130 and provides control of the overall guidance systems.

FIG. 9 illustrates particular stages in the acquisition receiver 112. In the circuit of FIG. 9, a pair of delay amplifiers 150 are connected in series with interspersed summing stages 152. An additional input signal from each amplifier 150 is applied to the following summing stage 152 to provide cancellation of reverberation reflections. Each stage of the circuit of FIG. 9 operates by delaying the received pulse position by the reciprocal of the pulse repetition rate (PRR) in stage 150 and then subtracting the next pulse return in the summing stage 152. This is then repeated for the third pulse in the second stage. If return pulse amplitude and phase do not change significantly in the three pulses, as is the case for reverberation reflections, they will be very small after the subtractions.

ACQUISITION MODE OPERATION

In the acquisition or search mode, initiated following water contact (as soon as the entry bubble collapses and wets the transducers) the acquisition mode is initiated with 50 watts of acoustic power being radiated out of each of the eight side-mounted transducers. This transmit pulse is supplied through the selectors 104, 106 and 102 in succession to simultaneously pulse all eight transducers 80 for equal distribution in all azimuths. This develops the acquisition beam pattern 18 shown in FIG. 2 for the weapon 10 immediately following water entry. After transmitting the pulse, the eight transducers 80 are scanned sequentially for return signals. The scan rate is sufficiently high that each of the eight sensors is interrogated once in each range resolution "cell" or time slot. Using a 60 millisecond (ms.) pulse, with a PRR of 1.5 pulses per second, the resulting waveform is unambiguous in range to approximately 1675 feet. The azimuth scanning rate breaks to 60 ms. pulse into eight segments, allowing a receiver processing bandwidth of 200 Hz per channel. Only six doppler channels are needed to accommodate target velocities of up to approximately 18 knots.

During the acquisition process, at least three pulses are transmitted. The reverberation reflections are partially cancelled (reduced by 35 dB) by the three-pulse canceller (see FIG. 9 and description above) in the acquisition receiver (which is an optimally matched filter for three pulses in Gaussian distributed reverberation).

The acquisition signals out of the receiver 112 are processed in the processor 114 to determine the presence of a target. The eight directions are time-multiplexed by the transducer selector 102 through the single receiver 112 and processor 114 with the 60 ms. transmit pulse being divided into eight 7.5 ms. time bins. No integration is used. Threshold detection of a target in a specific multiplexed bin presents both range and angle information—i.e. which of the eight transducers receives target signals—to the microprocessor 108. Range data is examined and verified as an initial steering command, and subsequent transition to the tracking mode is initiated. The acquisition system is configured to ensure detection, with range and angle information, with a target strength of −5 dB at 1500 feet in 2.75 seconds (when the noise limit is less than 53 dB).

TRACKING MODE OPERATION

While the weapon is turning toward the target as determined by the acquisition system portion of the FIG. 8 diagram, the guidance sub-system is switched to the track mode. Before completing the turn, the track system (also part of FIG. 8) starts sending pulses to present a search in elevation with a ±22.5 degree track beam. This is the active guidance beam pattern 20 shown in the center of FIG. 2 for the weapon 10 represented in the position directed toward the submarine 12. By initiating tracking approximately half way through the turn, an elevation search from −60 to +30 degrees is achieved. Once the tracking system acquires the target, the turn is terminated and the propulsion motor is pulsed.

The tracking sonar uses the full 500 watts peak power of the transmitter 110 for improved guidance accuracy. This is fed through the selector 104 to the mosaic array transducers 40. The transducers 40 are capable of operating at 500 watts at 100 kHz with a 45 degree beam width without cavitation. The array uses the concept of an inverse, phased-array to provide large surface area to achieve a wide beam width. The phasing of the individual array transducers 40 is entirely determined by physical position, and therefore the array has adequate bandwidth and is low in cost.

The receiver for the tracking pulses comprises the four hydrophones 120 of FIG. 8. The outputs of these hydrophones are combined in the arithmetic unit 122 to produce the two angle error signals (azimuth and elevation) and a sum signal. These are developed by subtracting the left hydrophone signal from the right hydrophone signal to determine the azimuth error signal and by subtacting the down hydrophone signal from the up hydrophone signal to determine the elevation error. The sum signal equals the sum of all four hydrophone signals.

The transmitted pulse width is 10 ms. The track processor, comprising the monopulse receiver 124 and the processors 108, 126, 128 and 130, uses 130 Hz bandwidth to track doppler information by determining both surface/bottom reverberation and target velocities to within 3.2 feet per second. The doppler processor is implemented in the sum channel 126. After detection, the microprocessor 108 causes the error processor 130 to perform a division of the difference channels by the sum channel, and the resulting normalized angle error signals are used for the steering commands.

Initial feasibility of the hydropulse motor propulsion system of the weapon of the invention has been demonstrated by testing of a miniaturized model and by computer simulation. A test model chamber of approximately 3" in diameter by 5" in length with a ⅛" diameter nozzle develops a thrust of 8.5 lbs. for an internal pressure of 375 psi.

Because of the conceptual and practical simplicity of the individual sub-systems of the weapon and their integration into the overall unit, extremely high reliability of the weapon is achieved with very low cost. There is no need for testing of units in the field which would potentially cause wear-out or damage. High user proficiency can be maintained, since the cost of the weapon is low enough to permit its use as an expendable training round. A warhead of 150 lbs. of explosive is sufficient to cause submarine hull rupture when detonated on contact. Thus the overall weight of the weapon can be minimized with an attendant increase in the capacity of helicopters or other ASW aircraft in terms of numbers of these weapons carried.

Although there have been described above specific arrangements of an anti-submarine weapon in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A weapon for destroying an underwater target comprising:
   - a housing;
   - a warhead mounted within the housing near the forward end thereof;
   - means for steering the weapon under water in response to steering control signals;
   - a hydropulse propulsion system including a chamber within the housing near the aft end thereof, a water jet nozzle projecting aft from the chamber, and means for periodically admitting sea water to the chamber and thereafter expelling the sea water through the nozzle with substantial force to develop thrust for propelling the weapon; and
   - a dual sonar system for seeking and detecting an underwater target and for generating signals to control the steering means to direct the weapon toward the target, said system including separate target seeking and detecting means which are selectively operable during different time periods in directing the weapon toward the target.

2. The weapon of claim 1 wherein the sea water admitting means comprises an inlet passage to the chamber and a valve for controlling the opening of the inlet passage.

3. The weapon of claim 2 further comprising means coupled to the valve for controlling it to alternatively open and close the inlet passage.

4. The weapon of claim 3 wherein said means comprises a solenoid actuator coupled to the valve.

5. A weapon for destroying an underwater target comprising:
   - a housing;
   - a warhead mounted within the housing near the forward end thereof;
   - means for steering the weapon under water in response to steering control signals; and
   - a hydropulse propulsion system including a chamber within the housing near the aft end thereof, a water jet nozzle projecting aft from the chamber, and means for periodically admitting sea water to the chamber and thereafter expelling the sea water through the nozzle with substantial force to develop thrust for propelling the weapon, the expelling means including:
   - a plurality of discrete gas generators mounted forward of the chamber,
   - a corresponding plurality of tubes individually associated with the gas generators, each connecting an associated gas generator with the chamber to transmit combusted gas to the chamber at substantial pressure, and
   - electrical ignition means coupled to the gas generators for selectively firing the gas generators individually in succession to develop a series of hydropulses of thrust to propel the weapon underwater.

6. The system of claim 5 further including control means for selectively activating the ignition means to ignite the gas generators individually at successive time intervals selected to develop a speed for the weapon during at least a portion of a coasting interval between firings which is below the speed at which onboard acoustic detectors are disabled by flow noise.

7. The weapon of claim 5 wherein the hydropulses of thrust are selectively timed, both as to duration and intervals between pulses, to develop a velocity profile for the weapon which permits the weapon to coast from a high top speed to a reduced minimum speed which is below the speed at which self-noise interferes with target detection by acoustic means.

8. The weapon of claim 5 wherein the weapon further comprises a rocket motor for propelling the weapon from ship-board launch through the air to a point of water entry in the vicinity of the target, said rocket motor comprising said hydropulse propulsion system chamber and a plurality of rocket jet nozzles extending rearwardly therefrom.

9. The weapon of claim 8 further including means for closing off the rocket jet nozzles following the burn-out of the rocket motor fuel.

10. The system of claim 6 wherein the time intervals between firings are selected to be approximately 3.5 seconds.

11. The weapon of claim 1 wherein the dual sonar system comprises an acquisition system including a plurality of side-mounted transducers spatially distributed about the sides of the weapon for transmitting and receiving acoustic signals within a lateral field surrounding the weapon.

12. The weapon of claim 11 wherein the acquisition system further includes a transducer selector and a signal processor for controlling the application of a transmitter pulse to the transducers and for sampling the respective transducers in succession for received signals indicative of reflection from a target.

13. The weapon of claim 12 wherein the acquisition system further includes means for responding to received signals from a given transducer and providing a command signal to the steering means for directing the weapon in the direction of the detected target.

14. The weapon of claim 13 wherein the dual sonar system further includes a tracking system having sonar pulse transmitting and receiving means mounted adjacent the nose of the weapon.

15. The weapon of claim 14 wherein the acquisition system signal processor further includes means for transferring control of the weapon from the acquisition system to the tracking system.

16. The weapon of claim 11 further including a tracking system comprising a pulse generator, a signal processor for controlling and timing the application of pulse signals, and an acoustic signal generator and receiver mounted in the nose of the weapon for transmitting sonar pulses under water and receiving reflected echos.

17. The weapon of claim 16 wherein the acoustic signal generator comprises a mosaic array of transducers oriented to generate a generally cone-shaped beam pattern forward from the nose of the weapon.

18. The weapon of claim 16 wherein the receiver comprises a plurality of hydrophones oriented to receive underwater acoustic signals and generate electrical signals indicative of direction to a target.

19. The weapon of claim 18 wherein the tracking system further comprises means for processing said electrical signals to generate steering command signals to control the weapon steering means to direct the weapon toward the target.

20. The weapon of claim 13 further comprising circuit means for discriminating between target and reverberation signals, by cancelling undesired reverberation reflection signals.

21. The weapon of claim 20 wherein the circuit means comprise a pair of delay stages connected in tandem, each delay stage having means for combining a signal received by the stage with an output signal from that stage in opposite polarity relationship.

22. The weapon of claim 16 wherein the signal processor is selectively operative to cause the transmitter to generate pulses at intervals when underwater speed is below a velocity at which self-noise blocks out acoustic signals indicative of target reflections.

23. The weapon of claim 22 wherein the hydropulse propulsion system generates a series of succeeding hydropulses, and wherein the sonar pulses for the tracking system are transmitted only during intervals between hydropulses.

24. A weapon for destroying an underwater target comprising:

a housing;

a warhead mounted within the housing near the forward end thereof;

means for steering the weapon under water in response to steering control signals;

a hydropulse propulsion system including a chamber within the housing near the aft end thereof, a water jet nozzle projecting aft from the chamber, and means for periodically admitting sea water to the chamber and thereafter expelling the sea water through the nozzle with substantial force to develop thrust for propelling the weapon; and a rocket motor for propelling the weapon from shipboard launch through the air to a point of water entry in the vicinity of the target; said rocket motor comprising said hydropulse propulsion system chamber, a plurality of rocket jet nozzles extending rearwardly therefrom, and means for closing off the rocket jet nozzles following the burn-out of the rocket motor fuel.

25. The system of claim 5 wherein each gas generator is operated to develop a pulse expelling sea water through the nozzle for approximately 1.7 seconds followed by a coasting interval of approximately 1.8 seconds to develop a velocity for the weapon which is below 35 knots for a substantial proportion of each pulse cycle.

* * * * *